United States Patent [19]

Shintaku

[11] 4,241,334

[45] Dec. 23, 1980

[54] ELECTRIC HORN WITH TWIN DRIVING ELECTROMAGNETS

[75] Inventor: Yoshishige Shintaku, Osaka, Japan

[73] Assignee: Ibuki Kogyo Co., Ltd., Osaka, Japan

[21] Appl. No.: 33,386

[22] Filed: Apr. 26, 1979

[30] Foreign Application Priority Data

Jan. 29, 1979 [JP] Japan ..... 54/8141
Feb. 8, 1979 [JP] Japan ..... 54/13716

[51] Int. Cl.[2] ..... G08B 3/10
[52] U.S. Cl. ..... 340/388; 340/401
[58] Field of Search ..... 340/388; 116/142 R; 179/115 R

[56] References Cited

FOREIGN PATENT DOCUMENTS 915478 1/1963 United Kingdom ..... 340/388

*Primary Examiner*—Harold I. Pitts
*Attorney, Agent, or Firm*—Daniel M. Rosen

[57] ABSTRACT

An electric horn is disclosed which has two electromagnets which are alternately and repeatedly energized so as to move a diaphragm to and fro in opposite directions. As a particular feature, a controller is disclosed which energizes these electromagnets at a frequency which is dependent upon ambient air temperature, so as to keep the wavelength of the emitted sound constant to provide a better match for the horn trumpet of the electric horn and cause better resonance therewith.

3 Claims, 5 Drawing Figures

ELECTRIC HORN WITH TWIN DRIVING ELECTROMAGNETS

BACKGROUND OF THE INVENTION

This invention relates to an electric horn which generates sound by vibrating a diaphragm by electromagnetic means.

In a conventional electric horn, a diaphragm is vibrated by an electromagnet which is intermittently energized by intermittent supply of electric current, and thereby sound is generated. The diaphragm is urged back to its rest position by a return spring means of some sort.

The strength of the electromagnet should therefore be great enough not only to displace the air in a manner to make the sound, but also to bias the spring means. This means that a heavy and bulky electromagnet is needed.

Especially in a horn mounted in a ship or boat, which is usually mounted as high up as possible in order to increase the distance of propagation of the sound, lightness and compactness are particularly desired.

In such a conventional horn the sound produced by the diaphragm is usually amplified or directed by a horn trumpet into which the sound is directed at its base, and which provides a sort of resonance chamber which magnifies the sound and orients it in a particular direction. Such a horn operates best when it is particularly matched to the incoming sound; that is, when its dimensions are correctly tailored to the *wavelength* (not the frequency) of the sound produced by the diaphragm. Now the frequency of the sound produced by the diaphragm is determined by the oscillating frequency of the combination of the diaphragm, the return spring means, and the electromagnet, when, as is usually the case, a simple feedback system is used for energizing the electromagnet, of the conventional sort, wherein the return of the diaphragm to its position remote from the electromagnet by the spring re-energized the electromagnet. Even when a more sophisticated means of providing pulses to the electromagnet is used, this oscillating or "natural" frequency of the above defined combination is very influential in determining the output frequency of the sound. Therefore this sound cannot be of any frequency desired, but has a certain preferred frequency. Therefore, in practical design, according to this preferred frequency, the wavelength of the emitted sound is calculated, assuming a median value for the ambient air temperature and pressure, which determine the speed of sound and hence the frequency/wavelength relation of sound. However, of course, when the air temperature in particular varies from this assumed value, the loudness and quality of the sound emitted by the horn drop substantially, because the wavelength of the sound emitted at the preferred frequency of vibration of the diaphragm assembly changes, and accordingly is not well matched to the physical size of the horn trumpet.

SUMMARY OF THE INVENTION

Therefore, it is an object of the present invention to provide an electric horn which is light and compact, wherein no spring return means is needed for the diaphragm such as could wear and lose its resilience.

According to the present invention, these and other objects are accomplished by an electric horn comprising a horn trumpet, an oscillating assembly comprising a diaphragm which is located at the base of the horn trumpet so that sound produced by said diaphragm enters the horn trumpet, and two electromagnets, which are arranged so as to act on the oscillating assembly and to urge it in opposite directions.

According to a particular feature of the present invention, a temperature stabilized horn is provided of the above type, further comprising a controller adapted to energize the electromagnets alternately and repeatedly, which comprises a pulse oscillator and a temperature sensor which controls the frequency of pulses generated by the pulse oscillator in such a manner that the wavelength of the sound emitted by the diaphragm during its oscillation in response to the urging of the electromagnets is substantially independent of air temperature over a certain range.

BRIEF DESCRIPTION OF THE DRAWINGS

The present invention will become more clearly understood from the following description of a preferred embodiment, and from the accompanying drawings, which, however, are all given only for the purposes of illustration and explanation, and are not to be considered as limiting the present invention in any way. In the drawings, like figures denote like parts in the several figures, and.

DESCRIPTION OF THE PREFERRED EMBODIMENT

Figure 1:
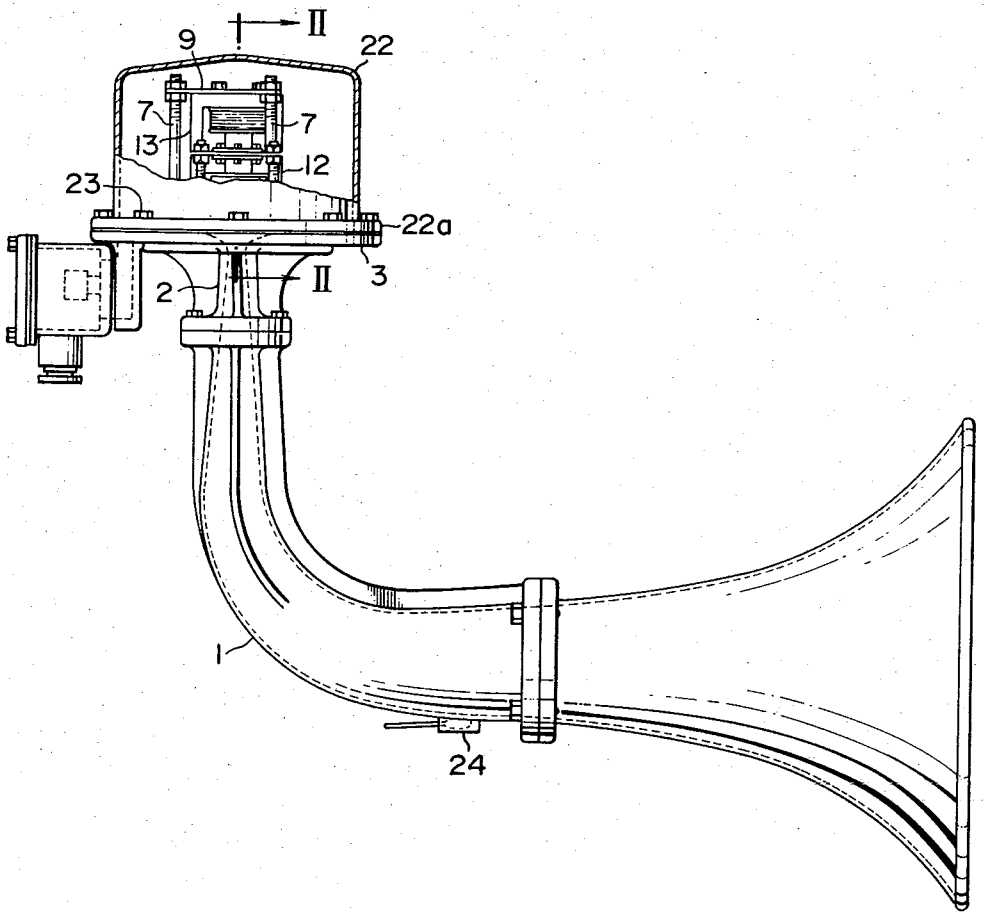
FIG. 1 is an elevational view, partly in section, of an embodiment of the electric horn according to the present invention.
Figure 2:
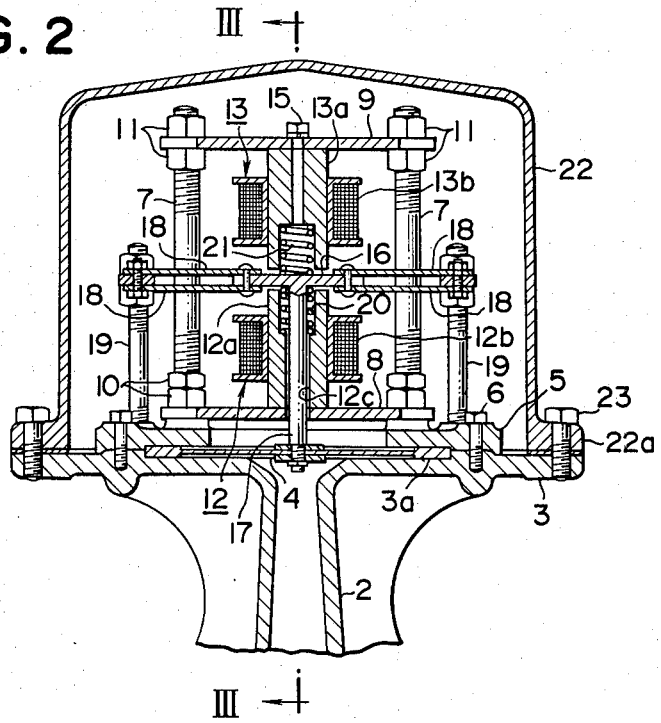
FIG. 2 is an enlarged longitudinal cross-section, taken along the line II—II in FIG. 1.
Figure 3:
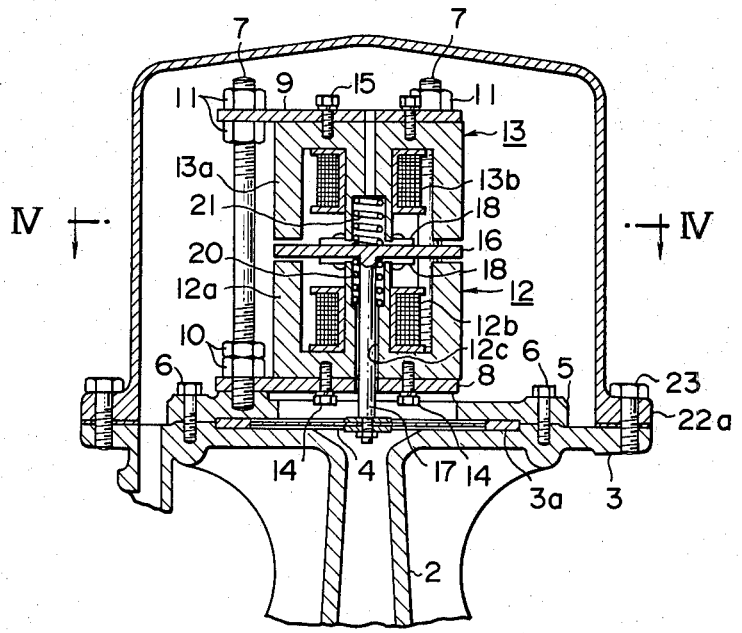
FIG. 3 is a longitudinal cross-section, taken along the line III—III in FIG. 2.
Figure 4:
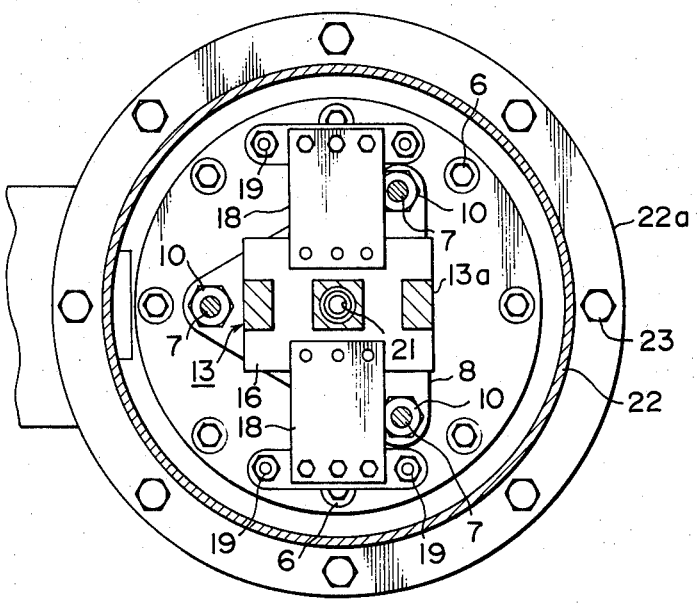
FIG. 4 is a transverse cross-section, taken along the line IV—IV in FIG. 3.

Referring to the drawings, there is shown therein an electric horn according to the present invention. A horn trumpet comprises a horn member 1 and a neck member 2 one end of which is jointed to the base end of the horn member 1. The neck member 2 has a flange 3 on its other end. The flange 3 is provided with a circular groove 3*a* in its center, in which a circular diaphragm 4 is fitted. The diaphragm 4 is held to the flange 3 of the neck member 2 by a retainer ring 5 by means of bolts 6.

Three screw support rods 7 are mounted upright onto the retainer ring 5 at the same intervals apart from one another. A pair of lower and upper support plates 8 and 9 of a triangular form are mounted to the lower and the upper ends of these support rods 7 by nuts 10 and 11 which are engaged therewith.

A pair of electromagnets 12 and 13 are mounted on the upper surface of the lower support plate 8 and the lower surface of the upper support plate 9 by mounting their cores 12*a* and 13*a*, which are stationary, by means of bolts 14 and 15. A pair of coils 12*b* and 13*b* are fitted on the cores 12*a* and 13*a*, respectively, and complete the electromagnet assemblies.

A movable core plate 16 having a rectangular form is arranged in the space between the two electromagnets 12 and 13 and is resiliently supported there by two pairs of spring plates 18, which are supported at their other ends by screw rods 19 which are screwed into the retainer ring 5. A coupling rod 17 extending vertically through a central hole 12*c* of the core 12*a* couples the centers of the movable core plate 16 and the diaphragm 4.

This movable core plate, for additional support, is supported at its lower and upper centers by a pair of supplementary coil springs 20 and 21 arranged in the lower and upper central holes 12*c* and 13*c* of the cores 12*a* and 13*a*.

The electromagnets 12 and 13 are covered by a cover 22 which has a flange 22*a* at its lower end and is fixed to the flange 3 of the neck member 2 by bolts 23.

A thermistor 24 for detecting the ambient temperature is attached to a proper portion of the horn member 1 and is connected to a pulse oscillator 25 to be hereinafter described.

Figure 5:
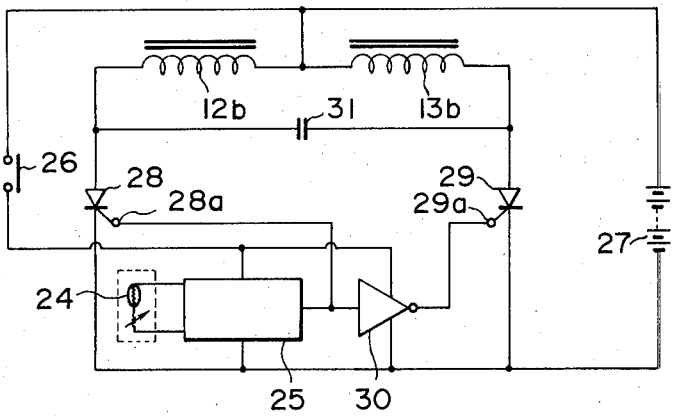
FIG. 5 is an electric circuit for driving the electric horn of FIGS. 1–4.

This electric horn works as follows: a power source 27 is switched on, and the coils 12*b* and 13*b* are alternately and repeatedly energized by the action of the circuit shown in FIG. 5.

Power from the power source 27 is connected, via the switch 26, to the coils 12*b* and 13*b* via thyristors 28 and 29 and the pulse oscillator 25. This oscillator 25 generates a trigger pulse having a rectangular waveform, of the frequency desired. This pulse triggers a gate 28*a* of the thyristor 28 directly, and a gate 29*a* of the thyristor 29 through an inverter 30. Hence the thyristor gates 28*a* and 29*a* are actuated in opposite phases. A communication condenser 30 is interposed between the anodes of the thyristors 28 and 29, so as to turn them off when they have been turned on.

Thus the coils 12*b* and 13*b* are energized alternately and repeatedly at the desired frequency, and the movable core plate 16 is drawn alternately by the electromagnets 12 and 13, and thereby sound is generated of the desired frequency.

The characteristic frequency of the assembly of the diaphragm 4, the spring plates 18, and the springs 20 and 21 is so tailored that it is approximately at the middle frequency of those desired. However, according to a particular characteristic of the present invention, the frequency of the pulse oscillator 25 is governed by the temperature sensing thermistor 24 in such a way as to keep the wavelength of the generated sound approximately constant, irrespective of temperature. That is, the higher is the air temperature, the lower is the frequency of the oscillator 25, and vice versa. By this arrangement, the sound generated is tailored always to be in good resonance with the trumpet horn 1—and other possibilities could be envisaged to exploit this flexibility in output sound frequency, such as a horn which emitted notes of different pitches, such as harmonics of a fundamental. It would be quite within the scope of the present invention also to correct the frequency of the oscillator 25 for ambient air pressure, by the way. This correction is of course performed only over a certain range.

The basic feature of the present invention, that of providing restoring force to the diaphragm of the electric horn by an electromagnet, instead of merely by a spring, means that a horn can be constructed which has a much more flexible characteristic as regards the possible range of frequencies of sound which it emits. The further feature of temperature-related stabilization of wavelength of emitted sound utilizes this basic feature advantageously to provide a louder electric horn. Further, the whole actuating members such as electromagnets 12 and 13, and so forth are closed up by the cover 22 and the diaphragm 4, as described above, so that the acoustic energy generated by the oscillation of the diaphragm 4 may be utilized effectively for emitting the sound.

Although the invention has been shown and described with reference to a preferred embodiment thereof, and with reference to the drawings, it should be understood that various changes, modifications, and omissions to the form and the content thereof may be made by one skilled in the art, without departing from the scope of the invention. Therefore it is desired that the scope of monopoly and protection afforded by Letters Patent should be delimited, not by any details of the illustrative embodiment, or of the drawings, but solely by the appended claims.

What is claimed is:

1. An electric horn, comprising:

a horn trumpet;

a diaphragm which is located at the base of the horn trumpet so that sound produced by said diaphragm enters the horn trumpet;

two electromagnets;

an oscillatory core plate which is arranged between the electromagnets and is coupled to the diaphragm by a coupling rod; and a controller adapted to energized the electromagnets alternately and repeatedly.

2. An electric horn according to claim 1, wherein the oscillatory core plate is supported by spring plates.

3. An electric horn according to claim 1 or 2, wherein the controller comprises a pulse oscillator and a temperature sensor which controls the frequency of pulses generated by the pulse oscillator in such a manner that the wavelength of the sound emitted by the diaphragm during its oscillation in response to the urging of the electromagnets is substantially independent of air temperature over a certain range.

* * * * *